US006560970B1

(12) United States Patent
Swift

(10) Patent No.: US 6,560,970 B1
(45) Date of Patent: May 13, 2003

(54) OSCILLATING SIDE-BRANCH ENHANCEMENTS OF THERMOACOUSTIC HEAT EXCHANGERS

(75) Inventor: Gregory W. Swift, Santa Fe, NM (US)

(73) Assignee: The Regents of the University of California, Los Alamos, NM (US)

( * ) Notice: Subject to any disclaimer, the term of this patent is extended or adjusted under 35 U.S.C. 154(b) by 0 days.

(21) Appl. No.: 10/165,700

(22) Filed: Jun. 6, 2002

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS

| | | | | |
|---|---|---|---|---|
| 4,590,993 A | | 5/1986 | Kurzweg | 165/104.31 |
| 5,642,623 A | * | 7/1997 | Hiresaki et al. | 62/6 |
| 6,032,464 A | | 3/2000 | Swift et al. | 60/520 |
| 6,279,324 B1 | * | 8/2001 | Zhu et al. | 62/6 |
| 6,330,800 B1 | * | 12/2001 | Price et al. | 62/6 |
| 6,351,954 B1 | * | 3/2002 | Nogawa et al. | 62/6 |
| 6,378,312 B1 | * | 4/2002 | Wang | 62/6 |
| 6,442,947 B1 | * | 9/2002 | Mitchell | 62/6 |

OTHER PUBLICATIONS

Backhaus et al., "A Thermoacoustic Stirling Heat Engine," Nature, vol. 399, pp. 335–338, May 27, 1999.

* cited by examiner

*Primary Examiner*—William C. Doerrler
(74) *Attorney, Agent, or Firm*—Ray G. Wilson

(57) ABSTRACT

A regenerator-based engine or refrigerator has a regenerator with two ends at two different temperatures, through which a gas oscillates at a first oscillating volumetric flow rate in the direction between the two ends and in which the pressure of the gas oscillates, and first and second heat exchangers, each of which is at one of the two different temperatures. A dead-end side branch into which the gas oscillates has compliance and is connected adjacent to one of the ends of the regenerator to form a second oscillating gas flow rate additive with the first oscillating volumetric flow rate, the compliance having a volume effective to provide a selected total oscillating gas volumetric flow rate through the first heat exchanger. This configuration enables the first heat exchanger to be configured and located to better enhance the performance of the heat exchanger rather than being confined to the location and configuration of the regenerator.

4 Claims, 8 Drawing Sheets

OSCILLATING SIDE-BRANCH ENHANCEMENTS OF THERMOACOUSTIC HEAT EXCHANGERS

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to regenerator-based oscillating-gas engines and refrigerators, and, more particularly, to thermoacoustic engines and refrigerators, including Stirling engines and refrigerators and pulse-tube refrigerators, and hybrids thereof.

BACKGROUND OF THE INVENTION

According to thermodynamic principles, acoustic power in a gas (a nonzero time average product of oscillating pressure and oscillating volumetric flow rate) is as valuable as other forms of work, such as electrical power, rotating shaft power, hydraulic power, and the like. For example, acoustic power can be used to produce refrigeration, such as in orifice pulse-tube refrigerators; it can be used to produce electricity, via linear alternators; and it can be used to generate rotating shaft power with a Wells turbine. Furthermore, acoustic power can be created from heat in a variety of heat engines such as Stirling engines and thermoacoustic engines. See, for example *Thermoacoustics: a unifying perspective for some engines and refrigerators*, G. W. Swift, to be published by the Acoustical Society of America in 2002; available in pre-publication format at http://www.lanl.gov/projects/thermoacoustics/Book/index.html.

Historically, Stirling's hot-air engine of the early 19th century was the first regenerator-based heat engine to use oscillating pressure and oscillating volumetric flow rate in a gas in a sealed system, although the time-averaged product of oscillating pressure and oscillating volumetric flow rate was not called acoustic power. Since then, a variety of related engines and refrigerators have been developed, including Stirling refrigerators, Ericsson engines, orifice pulse-tube refrigerators, standing-wave thermoacoustic engines and refrigerators, free-piston Stirling engines and refrigerators, and thermoacoustic-Stirling hybrid engines and refrigerators. Combinations thereof, such as the Vuilleumier refrigerator and the thermoacousically driven orifice pulse-tube refrigerator, have provided heat-driven refrigeration.

Much of the evolution of this entire family of acoustic-power thermodynamic technologies has been driven by the search for higher efficiency, greater reliability, and lower fabrication cost.

FIG. 1 shows one example of such a prior art regenerator-based engine: a thermoacoustic-Stirling hybrid engine, described in "Traveling Wave Device With Mass Flux Suppression," G. W. Swift, U.S. Pat. No. 6,032,464, Mar. 7, 2000; "A thermoacoustic-Stirling heat engine," S. Backhaus et al., Nature 399, 335–338 (1999); "A thermoacoustic-Stirling heat engine: Detailed study," S. Backhaus et al., J. Acoust. Soc. Am. 107, 3148–3166 (2000). The engine delivers acoustic power 10 to an unspecified load (e.g., a linear alternator or any of the aforementioned refrigerators) to its right. High-temperature heat, such as from a flame or from nuclear fuel, is added to the engine at hot heat exchanger 12, most of the ambient-temperature waste heat is removed from the engine at ambient heat exchanger 14, and oscillations of the gas are thereby caused.

As in all of the regenerator-based engines listed above, the conversion of heat to acoustic power occurs in regenerator 16, which is a solid matrix smoothly spanning the temperature difference between hot heat exchanger 12 and ambient heat exchanger 14, and containing small pores through which the gas oscillates. The pores must be small enough that the gas in them is in excellent local thermal contact with the heat capacity of the solid matrix. Proper design of toroidal acoustic network 18 (including, principally, inertance 22 and compliance 24) causes the gas in the pores of regenerator 16 to move toward hot heat exchanger 12 while the pressure is high and toward ambient heat exchanger 14 while the pressure is low. The oscillating thermal expansion and contraction of the gas in regenerator 16, attending its oscillating motion along the temperature gradient in the pores, is therefore temporally phased with respect to the oscillating pressure so that the thermal expansion occurs while the pressure is high and the thermal contraction occurs while the pressure is low.

Those skilled in the art understand that another way to view the operation of the thermoacoustic-Stirling hybrid engine, and indeed all regenerator-based engines including all Stirling and traveling-wave engines, is that acoustic power $\dot{E}_0$ flows into the ambient end (i.e., the end adjacent to ambient heat exchanger 14) of regenerator 16, is amplified in regenerator 16 by the temperature gradient in regenerator 16, and flows out of the hot end (i.e., the end adjacent to hot heat exchanger 12) of regenerator 16. Ideally, the acoustic-power amplification factor in regenerator 16 is equal to the ratio of hot temperature to ambient temperature, both temperatures being measured in absolute units such as Kelvin. In FIG. 1, the acoustic power $\dot{E}_H$ flowing out of the hot end of regenerator 16 through thermal buffer tube 72 splits into two portions $\dot{E}_{load}$ and $\dot{E}_{fb}$ at the resonator junction, with the required amount $\dot{E}_0$ flowing into the ambient end of regenerator 16 to provide the original acoustic power for amplification, and the rest $\dot{E}_{load}$ being delivered to the load. Hence, circulating acoustic power flows through regenerator 16 from ambient to hot and is amplified therein.

Two heat exchangers 12,14, one adjacent to each end of regenerator 16, are vital for the operation of such an engine. Both of these heat exchangers typically put the oscillating internal gas in intimate thermal contact with a steadily flowing external fluid such as water, air, or combustion products. Here, hot heat exchanger 12 must supply heat to the internal, thermodynamic working gas from an external heat source such as combustion products flowing from a burner. Similarly, ambient heat exchanger 14 must remove heat from the internal gas, rejecting that heat to an external heat sink such as a flowing stream of ambient-temperature water or air.

In common practice in heat exchanger design, both the internal gas and the external fluid are subdivided into many parallel portions that are interwoven, most often in cross flow. In a cross flow shell and tube heat exchanger, the internal gas often oscillates axially through a large number of parallel tubes, while the external fluid flows around the outside of the tubes perpendicular to the tube axes. In a finned tube heat exchanger, the external fluid may flow axially through a number of parallel tubes, while the internal gas oscillates around the finned outsides of the tubes perpendicular to the tube axes.

A similar description can be provided for a prior art thermoacoustic-Stirling hybrid refrigerator described in "Traveling Wave Device With Mass Flux Suppression," G. W. Swift, et al., U.S. Pat. No. 6,032,464, Mar. 7, 2000; "Acoustic recovery of lost power in pulse-tube refrigerators," G. W. Swift et al., J. Acoust. Soc. Am. 105, 711–724 (1999), shown in FIG. 2. Similar to the thermoacoustic-Stirling hybrid engine shown in FIG. 1, essential features of the refrigerator are that acoustic power $\dot{E}_0$ must flow through regenerator 32 from ambient heat exchanger 42 to cold heat exchanger, 38, acoustic power is thereby attenuated, and the pores of regenerator 32 must be small enough to provide excellent thermal contact between the gas and the solid matrix. Proper design of toroidal acoustic network 34 (including, principally, inertance 36 and compliance 38) causes the gas in the pores of regenerator 32 to move toward cold heat exchanger 38 while the pressure is high and toward ambient heat exchanger 42 while the pressure is low. Acoustic power $\dot{E}_C$ moves through thermal buffer tube 82 to combine with the input power $\dot{E}_{drive}$ to return through toroidal acoustic network 34. The oscillating entropy of the gas in regenerator 32, attending its oscillating pressure, is therefore temporally phased with respect to the oscillatory motion along the temperature gradient in the pores so that heat is pumped through regenerator 32 from cold heat exchanger 38 toward ambient heat exchanger 42.

As described for the engine above, two heat exchangers 38, 42, one adjacent to each end of regenerator 32, are required for the operation of such a refrigerator. Cold heat exchanger 38 must remove heat from the external heat load, such as flowing indoor air to be cooled, transferring that heat into the internal gas. Similarly, ambient heat exchanger 42 must remove heat from the internal gas, rejecting that heat to an external heat sink, such as a flowing stream of ambient-temperature water or air. Both heat exchangers 38, 42 typically put the oscillating internal gas in intimate thermal contact with a steadily flowing external fluid such as water or air, with both the internal gas and the external fluid subdivided into many parallel portions that are interwoven, most often in cross flow.

Another well-known form of regenerator-based refrigerator is the orifice pulse-tube refrigerator, described in "A review of pulse-tube refrigeration," R. Radebaugh, Adv. Cryogenic Eng. 35, 1191–1205 (1990), illustrated in FIG. 3. The oscillating motion and pressure, and resulting thermodynamic phenomena, in regenerator 52 and adjacent heat exchangers 54,56 are the same as those in the thermoacoustic-Stirling hybrid refrigerator shown in FIG. 2. Input acoustic energy $\dot{E}_0$ is amplified and output as $\dot{E}_C$ into pulse tube 104. However, whereas the thermoacoustic-Stirling hybrid refrigerator shown in FIG. 2 uses a toroidal acoustic network, the orifice pulse-tube refrigerator accomplishes the same thermodynamic phenomena with a simpler acoustic network 58 having no torus.

Those skilled in the art will understand that "ambient" temperature in this discussion refers to the temperature at which waste heat is rejected, and need not always be a temperature near ordinary room temperature. For example, a cryogenic refrigerator intended to liquefy hydrogen at 20 Kelvin might reject its waste heat to a liquid-nitrogen stream at 77 Kelvin; for the purposes of this cryogenic refrigerator, "ambient" would be 77 Kelvin. Those skilled in the art will also understand that "refrigerator" includes heat pumps.

Those skilled in the art also understand that, in the design of the gas dynamics in the regenerators of such engines and refrigerators, there is an optimal choice for the ratio of oscillating pressure to oscillating volumetric flow rate, while keeping their product at a desired value in order to keep the acoustic power at a desired level. Viscous dissipation of acoustic power in the regenerator is undesirable, and is avoided by keeping the oscillating volumetric flow rate as low as possible. On the other hand, the need to achieve significant heat transfer pushes designs toward high volumetric flow rate, and the need to avoid pressure-hysteresis losses limits the oscillating pressure. Hence, the ratio of oscillating pressure to oscillating volumetric flow rate should be high, but not too high. Typical design optimizations balancing these phenomena yield a ratio of oscillating pressure to oscillating volumetric flow rate on the order of magnitude of 10 times the gas density times the gas sound speed divided by the cross-sectional area of the regenerator.

Unfortunately, the aforementioned constraint on volumetric flow rate is equivalent to a bound on volumetric displacement, which in turn limits both the gas volume that each heat exchanger encloses and the gas volume that can be allocated to the space between the regenerator and a heat exchanger (e.g., in order to accommodate changes in cross section or direction between the regenerator and the heat exchanger). Hence, the heat exchangers that are adjacent to the regenerator in regenerator-based engines and refrigerators are typically short in the direction of the oscillatory motion of the gas, as broad in cross-sectional area as the regenerator itself, and abutted closely to the regenerator, as shown in FIG. 1 for hot heat exchanger 12 and ambient heat exchanger 14 and in FIGS. 2 and 3 for cold heat exchangers 38, 54 and ambient heat exchangers 42, 56.

These geometrical constraints make it difficult to build such heat exchangers cheaply and they make it difficult to achieve excellent heat transfer in such heat exchangers. The short, broad aspect ratio of such heat exchangers usually causes them to be made of many parallel subunits, so that the number of parts that must be handled, assembled, and bonded in a leak-tight fashion is large, causing high fabrication costs. The volume constraint leads either to low surface area or to a multiplicity of tiny passages, causing either poor heat transfer or high cost. The broad aspect ratio can also lead to low velocities, so that heat-transfer coefficients are low. The geometrical constraints can sometimes also preclude good heat transfer or low pressure drop on the non-thermoacoustic side of the heat exchanger, such as in the combustion-products stream of a burner-heated hot heat exchanger. The geometrical constraints can also lead to structural engineering challenges. For example, in an engine with a red-hot heat exchanger, such constraints make it difficult to provide the slight structural flexibility needed to accommodate slightly different thermal expansions in different portions of the heat exchanger, which can arise from slightly different hot temperatures in different portions of the heat exchanger.

Accordingly, in regenerator-based engines and refrigerators, it is desirable to provide greater geometrical freedom for one or more heat exchangers, in order that the heat exchanger(s) can have greater surface area, higher heat-transfer coefficient, and more structural design options. It is further desirable to make the oscillating volumetric flow rate and the oscillating volumetric displacement through a heat exchanger greater than that through the adjacent regenerator, in order that the heat exchanger can have greater surface area, higher flow velocity, and more structural design options.

Various features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention includes a regenerator-based engine or refrigerator having a regenerator with two ends at two different temperatures, through which a gas oscillates at a first oscillating volumetric flow rate in the direction between the two ends and in which the pressure of the gas oscillates, and first and second heat exchangers, each of which is at one of the two different temperatures. A dead-end side branch into which the gas oscillates has compliance and is connected adjacent to one of the ends of the regenerator to form a second oscillating gas flow rate additive with the first oscillating volumetric flow rate, the compliance having a volume effective to provide a selected total oscillating gas volumetric flow rate through the first heat exchanger.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION

In accordance with the present invention, a side-branch compliance is attached adjacent to one end of a regenerator to enable flexibility in the location of a heat exchanger. There are two overall options: either the heat exchanger can be in the side branch or the side branch can attach between the heat exchanger and the regenerator.

Figure 1:
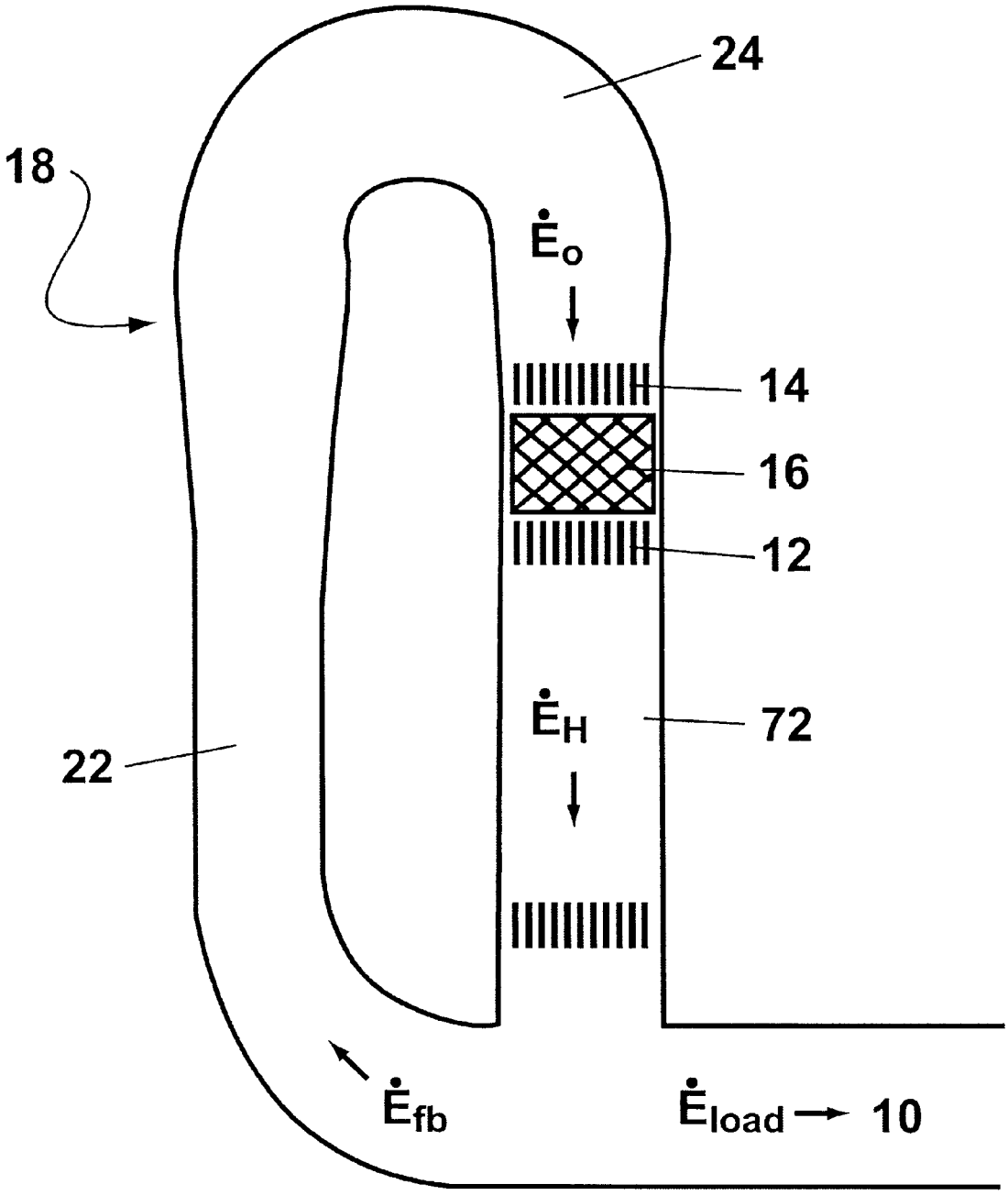
Fig. 1 (Prior Art)
FIG. 1 schematically depicts a thermoacoustic-Stirling hybrid engine (prior art).
Figure 4:
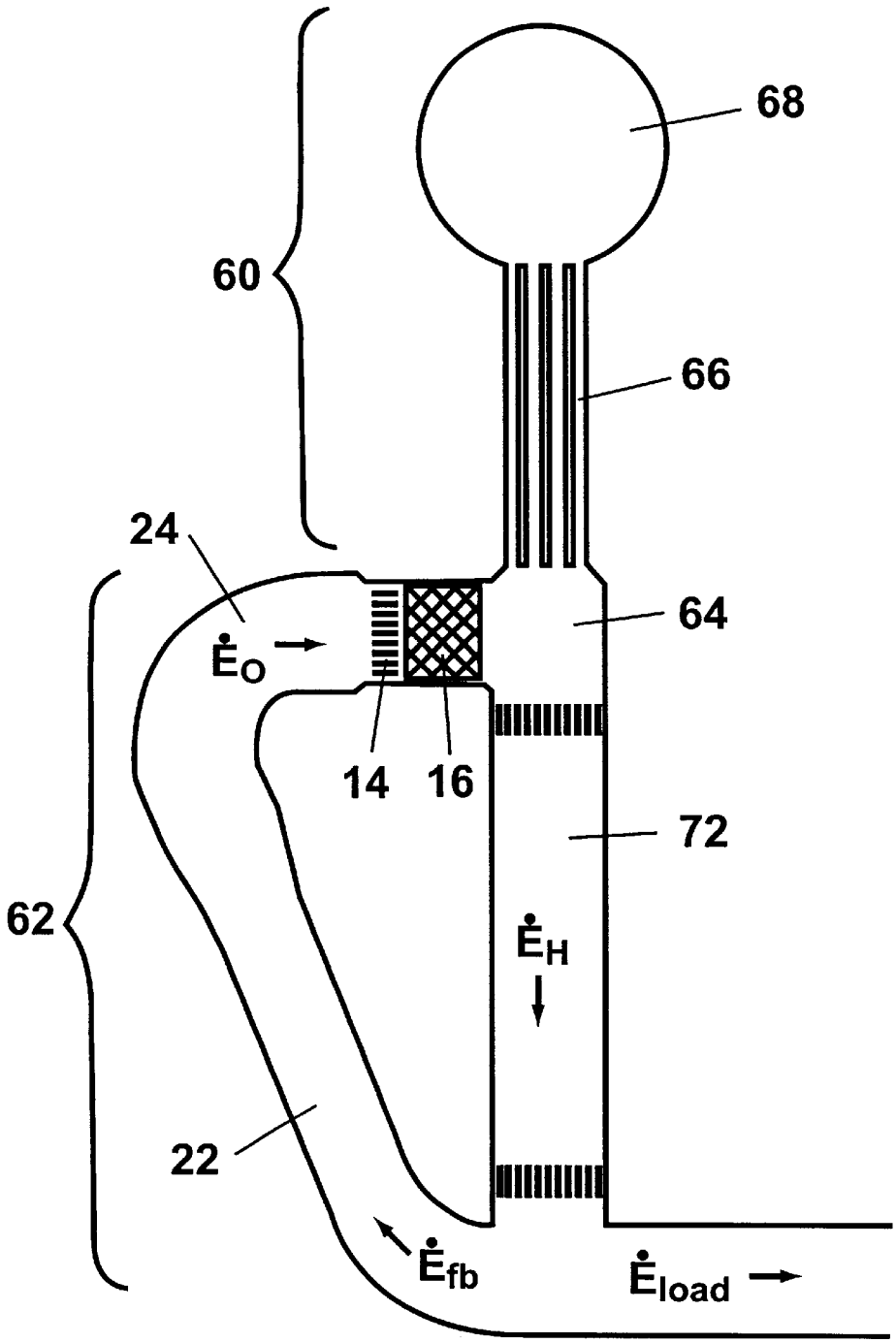
FIG. 4 schematically depicts a thermoacoustic-Stirling hybrid engine, with side-branch hot heat exchanger according to the present invention.

FIG. 4 schematically depicts a side-branch hot heat exchanger 60 for the thermoacoustic-Stirling hybrid engine that was shown in FIG. 1. Features that perform the same functions are numbered alike in FIGS. 1 and 4. Side branch 60 connects to the prior-art portion of the engine via side-branch junction 64 located at the hot end of regenerator 16. Hot heat exchanger 66 is located in side branch 60, close to side-branch junction 64, and side-branch compliance 68 is located at the dead end of side branch 60. The volume of side-branch compliance 68 is chosen to make the oscillating volumetric flow rate through hot heat exchanger 66 a desired value, typically making the peak-to-peak oscillating volumetric displacement comparable to the volume of gas in hot heat exchanger 66. The oscillating volumetric flow rate through thermal buffer tube 72 is then the sum of the volumetric flow rates through regenerator 16 and through hot heat exchanger 66, so thermal buffer tube 72 is longer and/or larger in diameter than in the prior-art engine show in FIG. 1. The oscillating volumetric displacement passing in and out of side-branch junction 64 via hot heat exchanger 66 is larger than the volume of the side-branch junction 64 region. Then side branch junction 64 region is supplied with a completely heated charge of hot gas from hot heat exchanger 66 during each cycle of the oscillation. In turn, the hot end of regenerator 16 is supplied with well-heated gas during each cycle of the oscillation.

In some cases, the freedom from geometrical constraints given by the side-branch 60 geometry provides the desired improvement, e.g., by allowing more space for combustion-side heat transfer if hot heat exchanger 66 is heated by a burner or by allowing more space to provide structural flexibility to accommodate differential thermal expansion mismatches. However, if improved thermoacoustic-side heat transfer is also desired in side-branch hot heat exchanger 66 in FIG. 4, the volume of side branch compliance 68 is made larger, causing a larger oscillating volumetric displacement through hot heat exchanger 66. This allows hot heat exchanger 66 to be larger, thereby allowing hot heat exchanger 66 to have greater surface area. The increased oscillating volumetric flow rate can also cause higher velocity and concomitant higher heat-transfer coefficient in the internal gas in hot heat exchanger 66.

Figure 2:
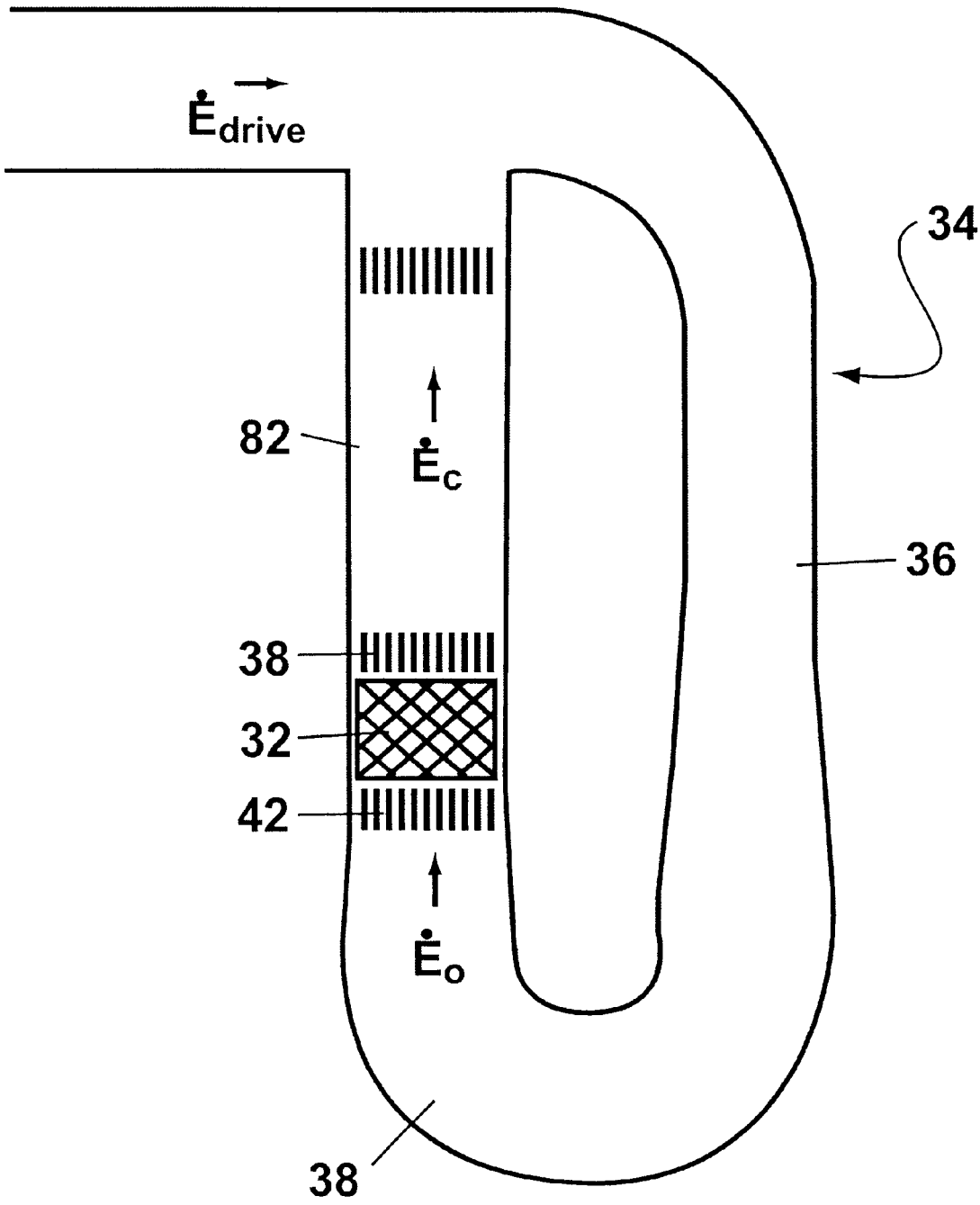
Fig. 2 (Prior Art)
FIG. 2 schematically depicts a thermoacoustic-Stirling hybrid refrigerator (prior art).
Figure 5:
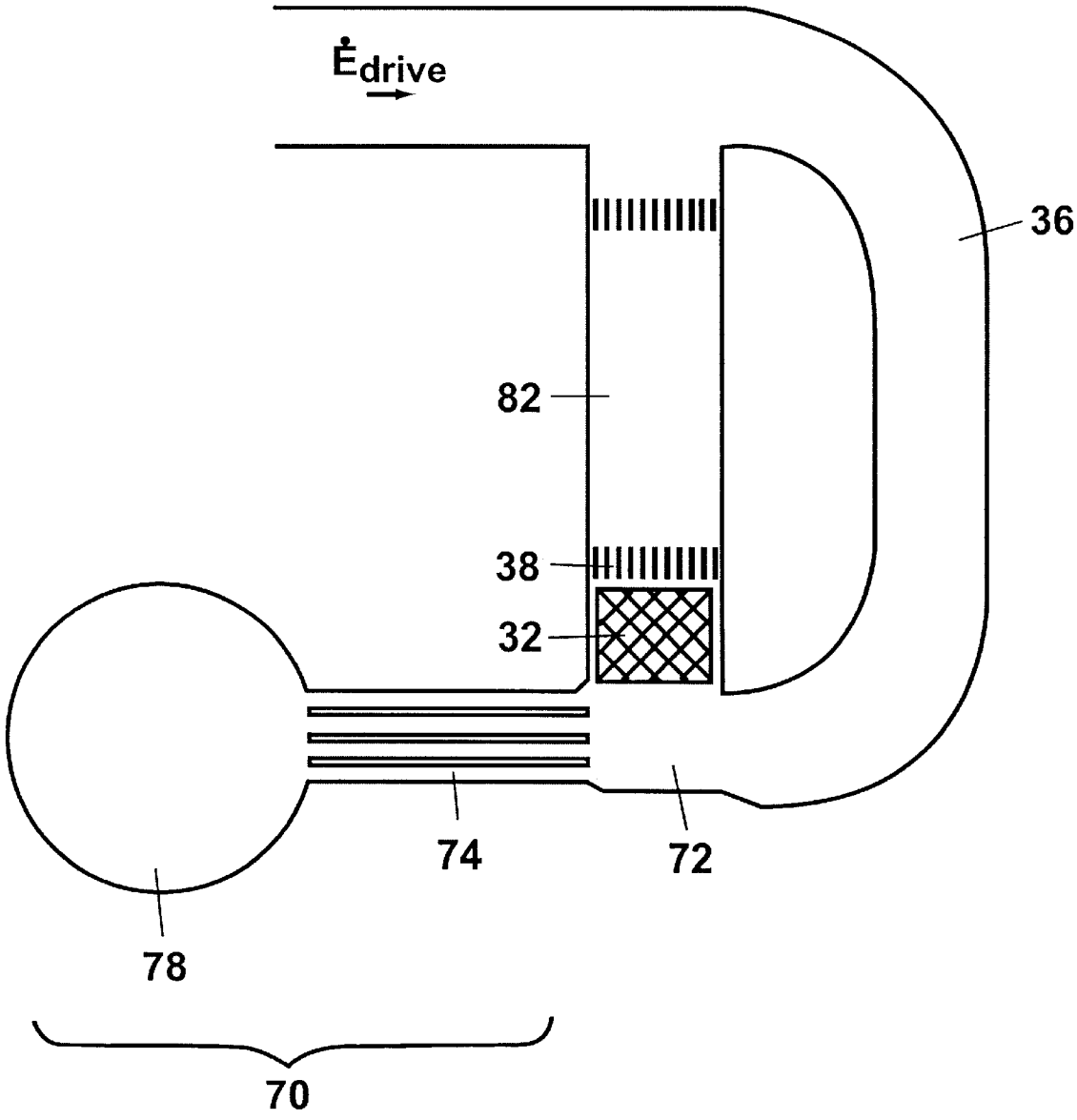
FIG. 5 schematically depicts a thermoacoustic-Stirling hybrid refrigerator, with side-branch ambient heat exchanger according to the present invention.

FIG. 5 shows a side-branch ambient heat exchanger for the thermoacoustic-Stirling hybrid refrigerator that was shown in FIG. 2. Again, components performing the same function are numbered alike in FIGS. 2 and 5. Side branch 70 connects to the prior-art portion of the refrigerator via side-branch junction 72 located at the ambient end of regenerator 32. Ambient heat exchanger 74 is located in side branch 70, close to side-branch junction 72. Side-branch compliance 78 is located at the dead end of side branch 70.

The choice of the volume of the side-branch compliance 78 and issues of volumetric displacement through and volume of ambient heat exchanger 74 and side-branch junction 72 involve considerations similar to those discussed in relation to FIG. 4. However, in FIG. 5, the extra oscillating volumetric flow rate required by side branch 70 must flow through inertance 36 instead of through thermal buffer tube 82. Hence, thermal buffer tube 82 can be the same as that in FIG. 2, while inertance 36 in FIG. 5 is shorter or larger in diameter than that of FIG. 2 in order to provide the same pressure difference in the presence of the larger oscillating volumetric flow rate.

Figure 6:
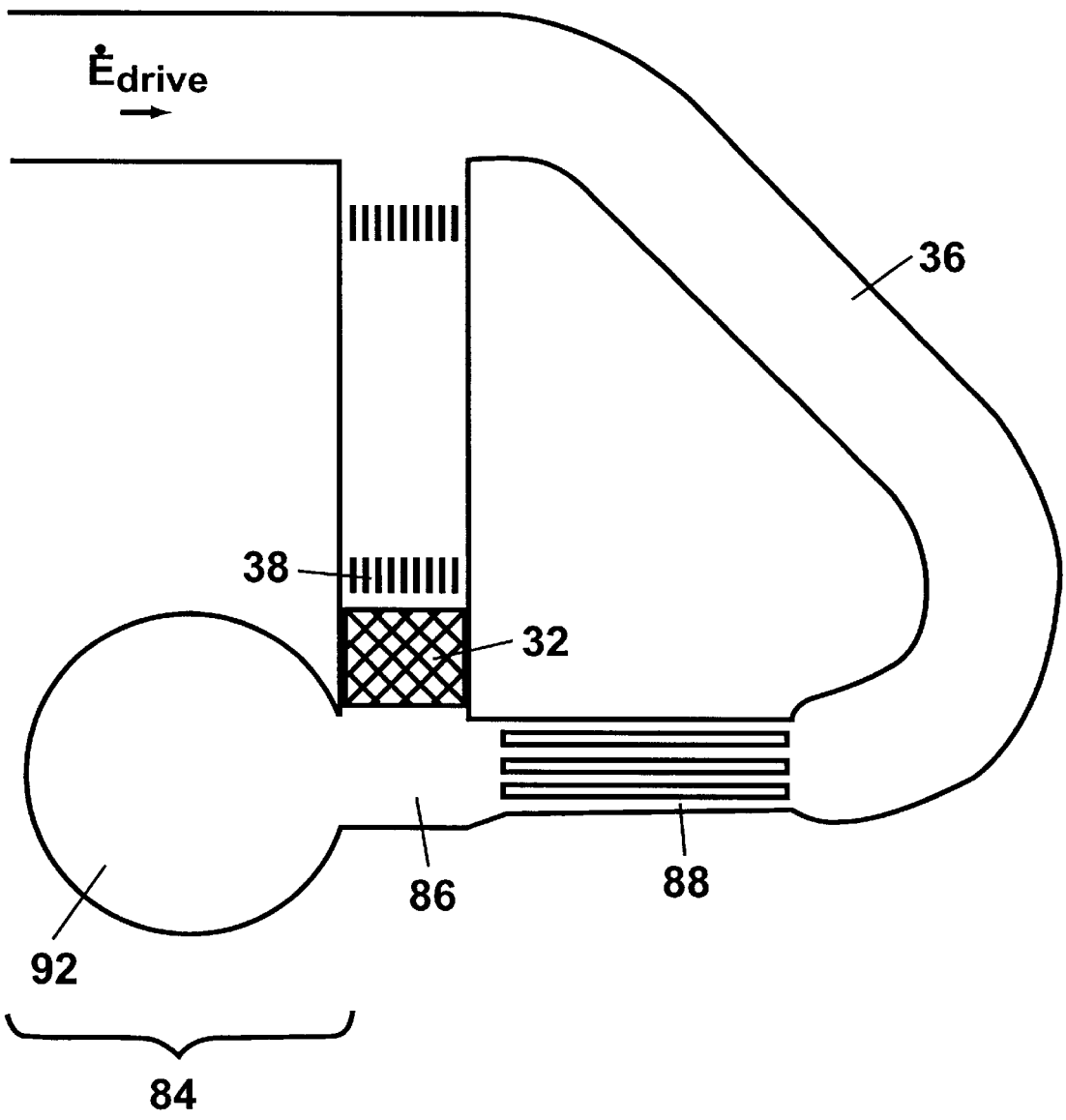
FIG. 6 schematically depicts a thermoacoustic-Stirling hybrid refrigerator, with side-branch ambient heat exchanger according to another embodiment of the present invention.

FIG. 6 shows another configuration for side-branch enhancement 84 of the ambient heat exchanger for the thermoacoustic-Stirling hybrid refrigerator that was shown in FIG. 2. Similar to FIG. 5, side branch 84 connects to the prior-art portion of the refrigerator via side-branch junction 86 located at the ambient end of regenerator 32. However, in FIG. 6 ambient heat exchanger 88 is not located in side branch 84. Instead, side branch 84 comprises only compliance 92, and side branch junction 86 is essentially located between regenerator 32 and ambient heat exchanger 88. Side-branch compliance 92 thus acts to increase the oscillating volumetric flow rate and oscillating volumetric displacement through ambient heat exchanger 88, so that ambient heat exchanger 88 can have greater surface area and/or a higher heat-transfer coefficient due to the higher oscillating velocity through it.

Side branch compliance 92 also serves the function of compliance 38 that is located in the torus shown in FIG. 2. If side branch compliance 92 has the same compliant impedance as compliance 38 in FIG. 2, then the sum of the inertial impedances of ambient heat exchanger 88 and inertance 36 must be the same as the inertial impedance of inertance 36 in FIG. 2 in order to create the same pressure difference across them. If side-branch compliance 92 has a larger volume that that of compliance 38, then the sum of the inertial impedances of ambient heat exchanger 88 and inertance 36 must be lower in order to create the same pressure difference across them in the presence of the increased oscillating volumetric flow rate through them.

Figure 3:
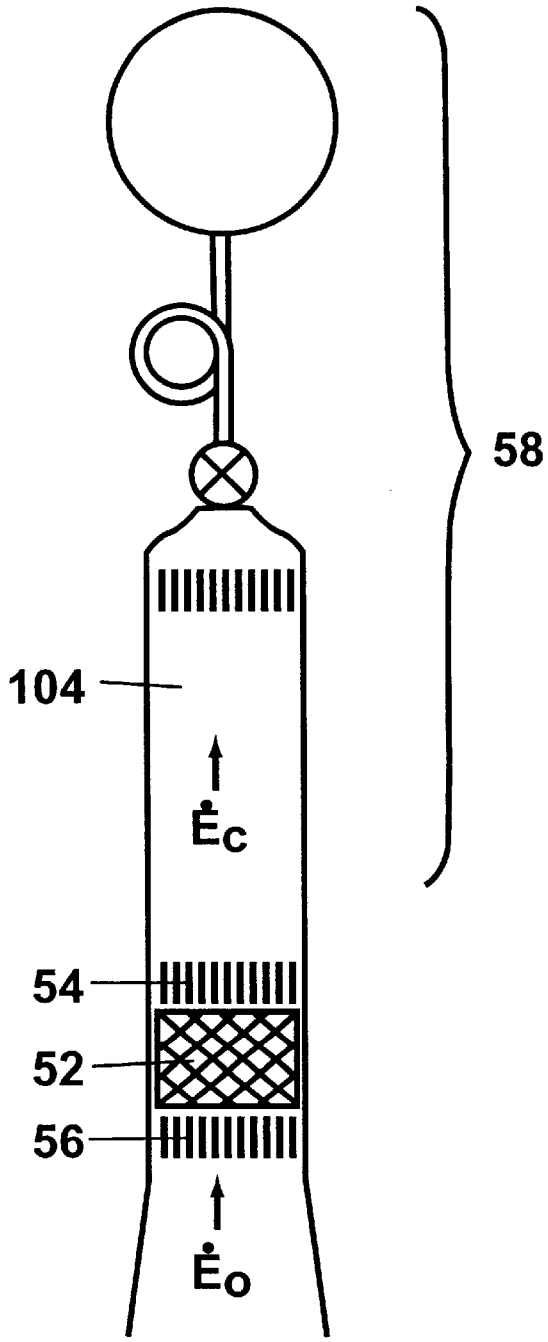
Fig. 3 (Prior Art)
FIG. 3 schematically depicts an orifice pulse-tube refrigerator (prior art).
Figure 7:
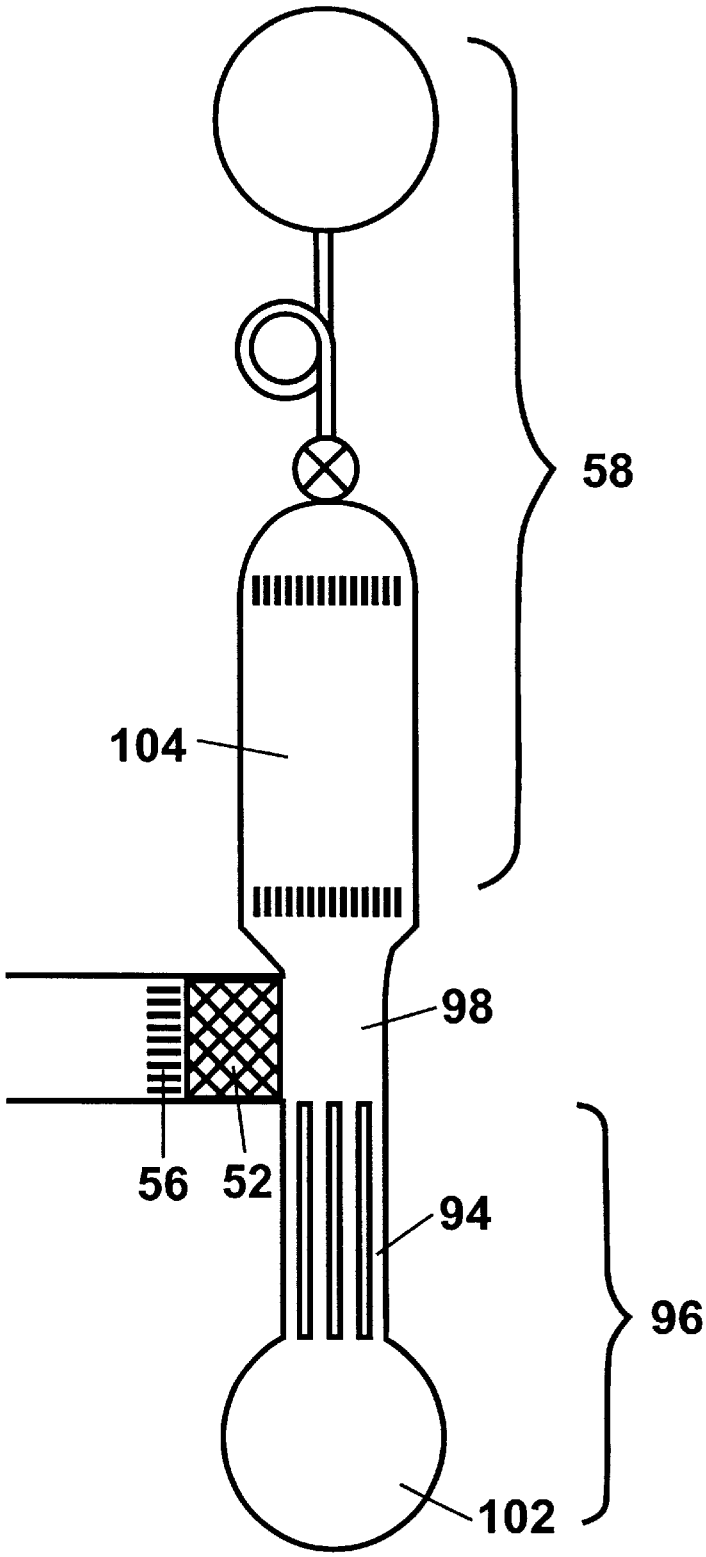
FIG. 7 schematically depicts an orifice pulse-tube refrigerator, with side-branch cold heat exchanger according to the present invention.

FIG. 7 shows a side-branch cold heat exchanger 94 for the orifice pulse-tube refrigerator that was shown in FIG. 3. Side branch 96 connects to the prior-art portion of the refrigerator via side-branch junction 98, which is located at the cold end of regenerator 52. Cold heat exchanger 94 is located in side branch 96, close to side-branch junction 98, with side-branch compliance 102 located at the dead end of side-branch 96. The choice of volume of side-branch compliance 102 and issues of volumetric displacement through and volume of cold heat exchanger 94, pulse-tube 104, and side-branch junction 98 involve considerations similar to those discussed in relation to FIG. 4, with pulse-tube 104 in FIG. 7 playing the role of thermal buffer tube 72 in FIG. 4.

Figure 8:
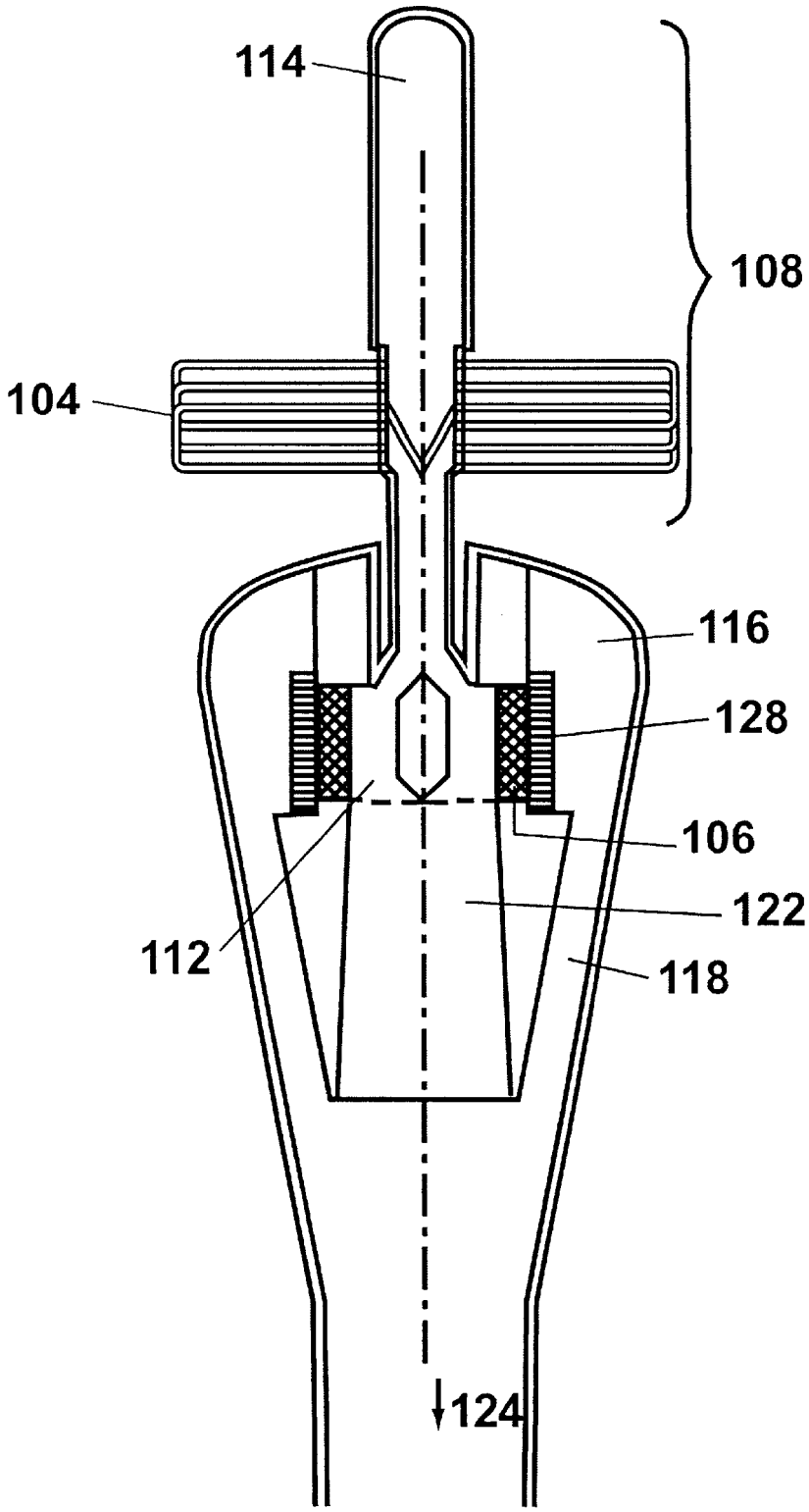
FIG. 8 schematically depicts a scale drawing of detailed design of a 50 kW thermoacoustic-Stirling hybrid engine, schematically shown in FIG. 4, with side-branch hot heat exchanger according to the present invention.

Finally, FIG. 8 shows a 50 kW engine designed according to the principles illustrated in FIG. 4, i.e., with side-branch 108 including hot heat exchanger 104 and compliance 114. The engine shown in FIG. 8 further includes compliance 116, inertance 118, and thermal buffer tube 122, with output 124 connected to a load. This engine is designed to oscillate at 40 cycles per second with 3.1 MPa helium gas, with an oscillating pressure amplitude of 0.3 MPa in regenerator 106. All parts except the tubes forming hot heat exchanger 104 have cylindrical symmetry about the vertical center line. For example, regenerator 106 and ambient heat exchanger 128 are annuli, with oscillating flow in the radial direction.

FIG. 8 illustrates the freedom in the design of hot heat exchanger 104 enabled by side branch 108. Absent the present invention, the hot heat exchanger of this engine would be confined to a location radially inboard from regenerator 106 (part of the space occupied by side-branch junction 112) and confined to a volume of the same order of magnitude as the volume of ambient heat exchanger 128. In contrast, with the present invention, hot heat exchanger 104 has a large volume, and a large surface area. There is increased room for the combustion gases to pass around hot heat exchanger 104 tubes, and the U-bend geometry of each of the forty eight tubes of hot heat exchanger 104 flexes to readily accommodate thermal expansion mismatches.

Other possibilities, not shown or described explicitly, will be apparent to those skilled in the art, such as an ambient side-branch heat exchanger on a pulse-tube refrigerator.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A regenerator-based engine refrigerator having a regenerator with two ends at two different temperatures, through which a gas oscillates at a first oscillating volumetric flow rate in the direction between the two ends and in which the pressure of the gas oscillates, and first and second heat exchangers, each of which is at one of the two different temperatures, wherein the improvement comprises:

a dead-end side branch into which the gas oscillates, having compliance and connected adjacent to one of the ends of the regenerator to form a second oscillating gas flow rate additive with the first oscillating volumetric flow rate, the compliance having a volume effective to provide a selected total oscillating gas volumetric flow rate through the first heat exchanger.

2. The regenerator-based engine or refrigerator of claim 1, wherein the first heat exchanger is located in the dead-end side branch.

3. The regenerator-based engine or refrigerator of claim 1, wherein the engine or refrigerator is a thermoacoustic-Stirling hybrid engine or refrigerator.

4. The regenerator-based engine or refrigerator of claim 1, wherein the engine or refrigerator is an orifice pulse-tube refrigerator.

* * * * *